US008893603B2

(12) United States Patent
Weber et al.

(10) Patent No.: US 8,893,603 B2
(45) Date of Patent: Nov. 25, 2014

(54) CABLES WITH INTERTWINED STRAIN RELIEF AND BIFURCATION STRUCTURES

(71) Applicant: Apple Inc., Cupertino, CA (US)

(72) Inventors: Douglas J. Weber, Arcadia, CA (US); Jonathan S. Aase, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/894,822

(22) Filed: May 15, 2013

(65) Prior Publication Data

US 2013/0298518 A1 Nov. 14, 2013

Related U.S. Application Data

(62) Division of application No. 12/892,315, filed on Sep. 28, 2010, now Pat. No. 8,467,560.

(51) Int. Cl.

| | |
|---|---|
| ***D07B 1/16*** | (2006.01) |
| ***H04R 1/10*** | (2006.01) |
| *H01B 13/16* | (2006.01) |

(52) U.S. Cl.

CPC . *D07B 1/16* (2013.01); *H01B 13/16* (2013.01); *H04R 1/1033* (2013.01)

USPC ..... 87/8; 87/13

(58) Field of Classification Search

USPC ..... 87/8, 11, 13

See application file for complete search history.

(56) References Cited

U.S. PATENT DOCUMENTS

| | | | | |
|---|---|---|---|---|
| 1,523,051 | A | 1/1925 | Carpenter et al. | |
| 1,706,284 | A | 3/1929 | Fortin | |
| 4,363,019 | A | 12/1982 | Miyamoto et al. | |
| 4,509,877 | A | 4/1985 | Sobin et al. | |
| 5,339,657 | A * | 8/1994 | McMurray | 66/195 |
| 5,388,497 | A * | 2/1995 | Akiyama et al. | 87/34 |
| 5,398,586 | A * | 3/1995 | Akiyama et al. | 87/6 |
| 6,409,750 | B1 * | 6/2002 | Hyodoh et al. | 623/1.1 |
| 6,622,604 | B1 * | 9/2003 | Chouinard et al. | 87/11 |
| 6,907,810 | B2 * | 6/2005 | Kim | 87/16 |
| 7,004,967 | B2 * | 2/2006 | Chouinard et al. | 623/1.15 |
| 7,069,835 | B2 * | 7/2006 | Nishri et al. | 87/11 |
| 7,311,030 | B2 * | 12/2007 | Renaud | 87/8 |
| 7,444,916 | B2 * | 11/2008 | Hirukawa | 87/34 |
| 7,622,670 | B1 | 11/2009 | Sanderson et al. | |

(Continued)

FOREIGN PATENT DOCUMENTS

| | | |
|---|---|---|
| JP | 08-315645 | 11/1996 |
| JP | 2006-093018 | 4/2006 |
| WO | 2010/051856 | 5/2010 |

*Primary Examiner* — Shaun R Hurley

(74) *Attorney, Agent, or Firm* — Van Court & Aldridge LLP

(57) ABSTRACT

An electrical device such as a headset may have a cable. Wires in the cable may be used to connect speakers in the headset to a connector such as an audio jack. The cable may have a tubular intertwined cable cover that covers the wires. Computer-controlled servo motors in fiber intertwining equipment may be adjusted in real time so that intertwined attributes such as intertwining density and intertwining tension are varied as a function of length along the intertwined cable cover. The fiber intertwining equipment may make these variations to locally increase the strength of the intertwined cable cover and the cable in the vicinity of a bifurcation in the cable and in the vicinity of the portion of the cable that terminates at the audio jack.

19 Claims, 11 Drawing Sheets

(56) References Cited

U.S. PATENT DOCUMENTS

| | | | | |
|---|---|---|---|---|
| 7,908,956 | B2 * | 3/2011 | Dow et al. | 87/16 |
| 8,006,601 | B2 * | 8/2011 | Inazawa et al. | 87/1 |
| 8,442,257 | B2 | 5/2013 | Aase et al. | |
| 2002/0111674 | A1 * | 8/2002 | Chouinard et al. | 623/1.35 |
| 2004/0094024 | A1 * | 5/2004 | Kim | 87/6 |
| 2005/0020319 | A1 | 1/2005 | Kim et al. | |
| 2005/0150370 | A1 * | 7/2005 | Nishri et al. | 87/33 |
| 2009/0188380 | A1 * | 7/2009 | Dow et al. | 87/11 |
| 2010/0315299 | A1 | 12/2010 | Bibl et al. | |
| 2010/0316229 | A1 | 12/2010 | Bibl et al. | |
| 2011/0054589 | A1 * | 3/2011 | Bashiri et al. | 623/1.15 |

* cited by examiner

CABLES WITH INTERTWINED STRAIN RELIEF AND BIFURCATION STRUCTURES

This U.S. Patent Application claims priority from commonly-assigned U.S. patent application Ser. No. 12/892,315, filed Sep. 28, 2010, which is hereby incorporated by reference in its entirety.

BACKGROUND

This invention relates to structures formed from intertwined fibers, and more particularly, to ways in which to form structures for electronic devices from intertwined fibers.

Electronic devices such as music players often use headsets. Some headsets are formed from wires that are contained within a cable formed from braided fibers. Seams may be present at a bifurcation where the headset cable splits into left and right branches. The end of the cable may be terminated with an audio jack. To help prevent damage to the cable in the vicinity of the audio jack, a plastic strain relief structure is typically formed over the cable.

Headsets with cables such as these may be unsightly due to the presence of undesired seams and strain relief features. Moreover, if care is not taken, the fibers of the cable may be prone to unraveling in the vicinity of the bifurcation.

It would therefore be desirable to be able to provide improved cable structures such as improved intertwined cables with bifurcations and strain relief structures for devices such as headsets.

SUMMARY

Accessories such as audio headsets may include cabling. A cable for an audio headset may contain wires. The wires in a headset may be electrically connected between headset components such as speakers, buttons, and an audio jack or other connector.

To provide the cable in a headset or other device with an attractive and durable finish, the cable may be covered with an intertwined cable cover (e.g., a braided or woven cable cover). Fibers in the intertwined cable cover may be formed from polymers or other suitable materials.

Fibers may be intertwined to form the intertwined cable cover using computer-controlled intertwining equipment (e.g., braiding or weaving equipment). The intertwining equipment may include servo motors that can be controlled in real time to adjust interweaving formation parameters such as intertwining density and intertwining tension (e.g., braid density and braid tension or weave density and weave tension). The intertwining density and intertwining tension of an intertwined cable cover may affect the attributes of the intertwined cable cover. For example, segments of an intertwined cable cover that are formed with an elevated intertwining tension and an elevated intertwining density may be stiffer and more durable than segments of the intertwined cable cover that are formed with reduced intertwining tension and intertwining density.

To accommodate left and right speakers, the cable in the headset may have a bifurcation. Below the bifurcation, the wires may be covered in a single segment of intertwined cable cover. Above the bifurcation, the cable cover can split into left and right portions. The bifurcation can be formed seamlessly using the intertwining equipment. To reduce the susceptibility of the intertwined cable cover to unraveling fibers in the vicinity of the bifurcation, one or more intertwined attributes such as intertwining density and intertwining tension may be locally increased in a segment of the cable that includes the bifurcation.

There is a potential for strain to damage the cable in the vicinity of the segment of cable that terminates at the audio jack. This segment of cable may also be locally increased in strength. In particular, the intertwining equipment may locally increase intertwining tension and intertwining density to form an integral strain relief structure in the cable cover at the audio jack. The audio jack may also be provided with an internal tapered strain relief member.

Further features of the invention, its nature and various advantages will be more apparent from the accompanying drawings and the following detailed description of the preferred embodiments.

DETAILED DESCRIPTION

Cables may be used in headphones, patch cords, power cords, or other equipment they conveys electrical signals. As an example, cables are sometimes described herein in the context of accessories such as headsets. This is, however, merely illustrative. Any suitable apparatus may be provided with a cable if desired.

Figure 1:
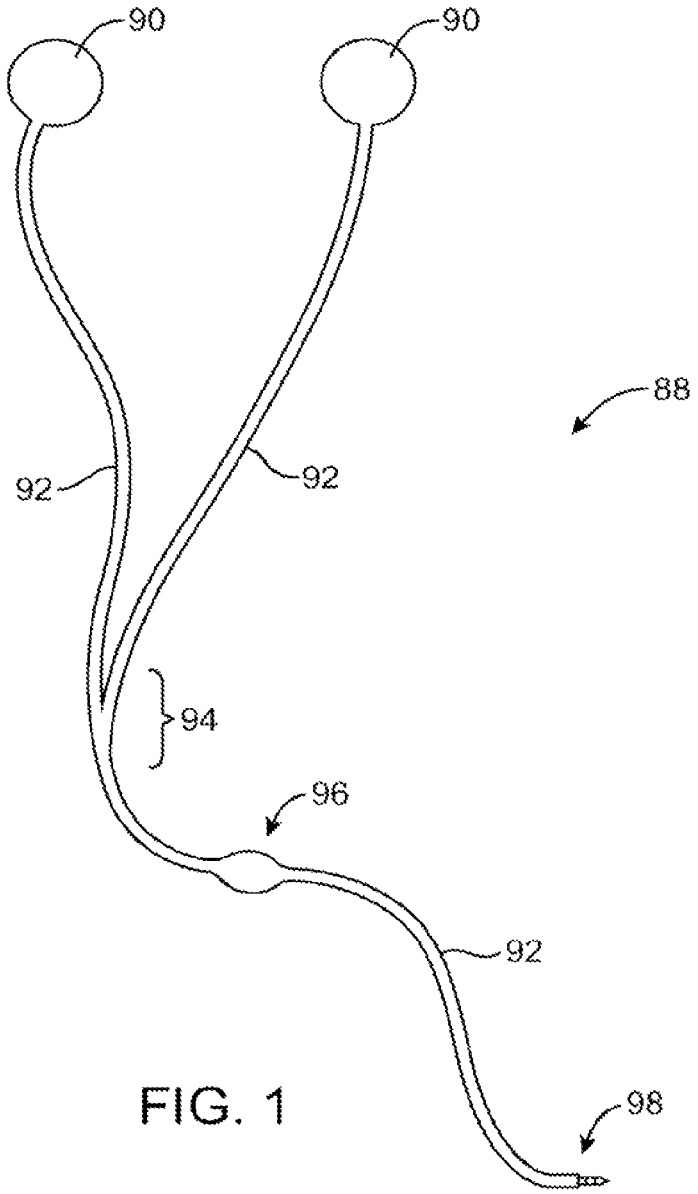
FIG. 1 is a perspective view of an illustrative accessory such as a headset that has been formed from intertwined fibers in accordance with an embodiment of the present invention.

The inner portions of a cable may contain wires for carrying power and data signals and an optional strengthening cord. Electromagnetic shielding (e.g., a metal braid, interwoven metal, and/or wrapped metal foil), a plastic sheath, and other layers may be used to cover the wires and strengthening cord. To provide the cable with an attractive and durable outer layer, the cable may be covered with intertwined fibers. The intertwined fibers of the outer layer may be formed by an intertwining tool such as an intertwining tool. The outer layer may have a tubular shape and may sometimes be referred to as an intertwined fiber cable cover or tubular intertwined fiber cable cover. An illustrative device that may include cabling with an intertwined cable cover is the headset shown in FIG. 1. As shown in FIG. 1, headset 88 may include a main cable portion 92. Cable 92 may be formed from intertwined fibers and may have portions formed from different types and amounts of fibers and different patterns and amounts of binder and coatings (as examples). Speakers 90 may be mounted at the ends of the right and left branches of cable 92. In region 94, cable 92 may have a bifurcation (forked region). Feature 96 may be an enclosure for a switch, microphone, etc. The end of cable 92 may be terminated by a connector such as audio jack 98.

Figure 2:
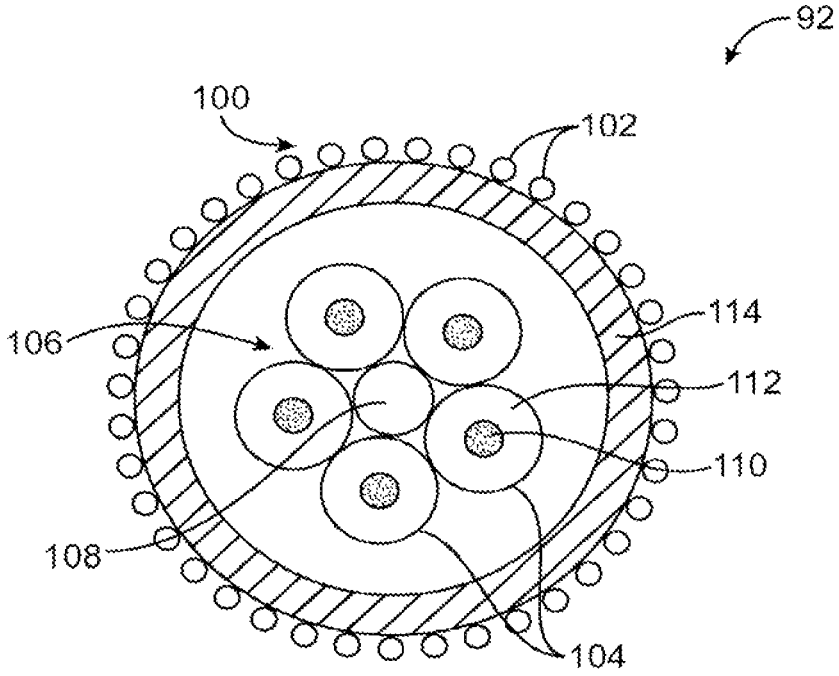
FIG. 2 is a cross-sectional view of a cable in accordance with an embodiment of the present invention.

A cross-sectional view of cable 92 is shown in FIG. 2. As shown in FIG. 2, cable 92 may include fibers 102 that have been intertwined to form a cable cover such as cover 100. Cover 100 may be formed from an elongated tube (sheath) of fibers 102 that are intertwined using an intertwining tool (as an example).

Cover 100 may enclose fibers such as fibers 106. Fibers 106 may include wires 104 for conducting electrical signals. Wires 104 may be used to carry power, digital signals, analog signals, etc. Wires 104 may include conductors 110 such as stranded conductors or solid conductors. Wire insulation 112 may be provided by dielectric coatings (e.g., polymer coatings). Fibers 106 may also include one or more strengthening cords such as optional cord 108 (e.g., a cord formed from polymer fibers such as aramid fibers).

Fibers 106 may optionally be covered with one or more layers such as layer 114. Layer 114 may include one or more layers of electromagnetic shielding structures (e.g., intertwined or wrapped foil conductive sheaths that surround bundles of wires within jacket 100) and/or plastic sheath layers (e.g., an inner jacket for cable 92).

Cable 92 may include any suitable number of wires 104 (e.g., one or more). For example, cable 92 may include two wires 104 (e.g., a positive wire and a negative wire). Cable 92 may also include three wires 104, four wires 104, five wires 104, six wires 104, or more than six wires 104. Arrangements with more wires 104 may be used to handle additional audio channels (e.g., left and right speaker channels, surround sound channels, etc.). Arrangements with more wires 104 may also be able to use two or more wires 104 for conveying power (e.g., by forming a power path that is not used to handle any data signals or that handles only a minimal number of data signals). The incorporation of additional wires 104 within cable 92 may also allow cable 92 to handle control signals (e.g., by providing a signal path for conveying signals from a controller in region 96 of headset 88 of FIG. 1 to connector 98).

Cover 100 may include intertwined fibers 102. Binder materials (sometimes referred to as matrix materials) such as epoxy or other binders that fill interstitial spaces between intertwined fibers, coatings, or other suitable materials may, if desired, be incorporated into some or all of cover 100.

Cover 100 may be formed from one or more layers of fibers 102. As shown in the illustrative cross-sectional view of FIG. 2, cover 100 may be formed from a single layer of intertwined fibers 102 (as an example).

Fibers 102 may be formed from any suitable materials. Examples of fibers 102 include metal fibers (e.g., strands of steel or copper), glass fibers (e.g., fiber-optic fibers that can internally convey light through total internal reflection), plastic fibers, etc. Some fibers may exhibit high strength (e.g., polymers such as aramid fibers). Other fibers such as nylon may offer good abrasion resistance (e.g., by exhibiting high performance on a Tabor test). Yet other fibers may be highly flexible (e.g., to stretch without exhibiting plastic deformation). Fibers may have different magnetic properties, different thermal properties, different melting points, different dielectric constants, different conductivities, different colors, etc.

The fibers of cable 92 including cable cover fibers 102 and interior fibers 106 (e.g., wires 104 and strengthening cord 108) may be formed from metal, dielectric, or other suitable materials. The fibers of cable 92 may be relatively thin (e.g., less than 20 microns or less than 5 microns in diameter—i.e., carbon nanotubes or carbon fiber) or may be thicker (e.g., metal wire). The fibers of cable 92 may be formed from twisted bundles of smaller fibers (sometimes referred to as filaments) or may be formed as unitary fibers of a single untwisted material. Regardless of their individual makeup (i.e., whether thick, thin, or twisted or otherwise formed from smaller fibers), the strands of material that make up the wires, strengthening cords, and fibers in cover 100 are referred to herein as fibers. In some contexts, the fibers of cable 92 may also be referred to as cords, threads, ropes, yarns, filaments, strings, twines, etc.

Figure 3:
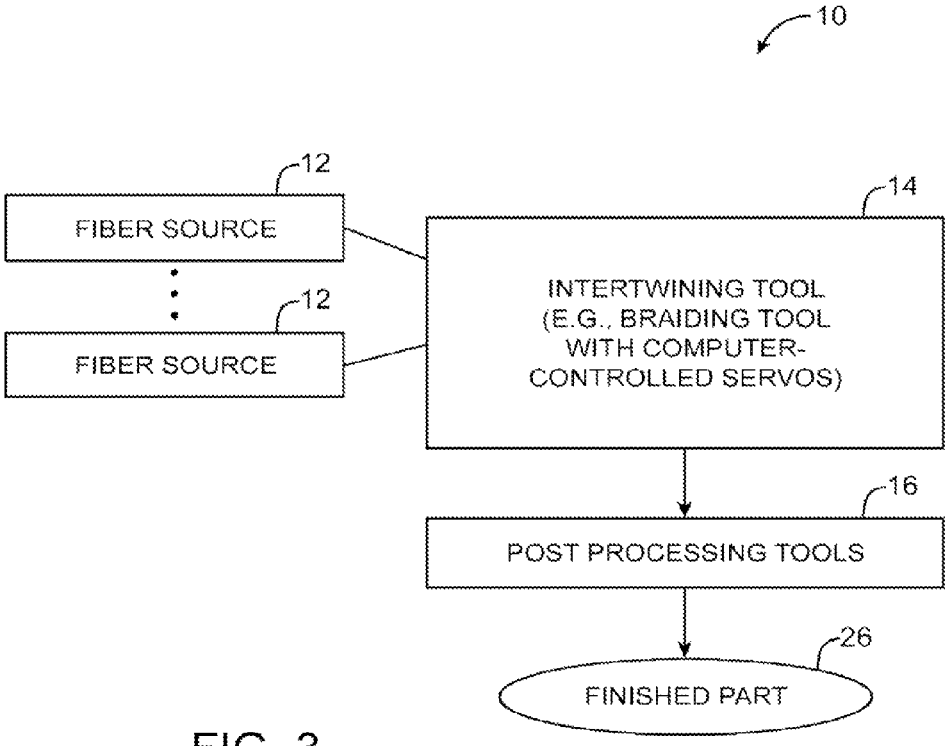
FIG. 3 is a schematic diagram of illustrative equipment that may be used in forming cables and associated devices in accordance with an embodiment of the present invention.

Fabrication equipment of the type that may be used to form headset 88 is shown in FIG. 3. As shown in FIG. 3, fabrication equipment 10 may be provided with fibers from fiber sources 12. Fiber sources 12 may provide fibers of any suitable type. Examples of fibers include metal fibers (e.g., strands of steel or copper with or without insulating coatings such as sheaths of plastic), glass fibers (e.g., fiber-optic fibers that can internally convey light through total internal reflection), plastic fibers, etc.

Intertwining tool(s) 14 may be based on any suitable fiber intertwining technology. For example, intertwining equipment 14 may include computer-controlled intertwining tools. Equipment 14 may be used to form tubular interwoven structures such as cover 100 surrounding fibers 106 (e.g., around wires 104 and one or more strengthening cords 108). Seamless bifurcations (see, e.g., bifurcation 94 of FIG. 1) may be formed in a tubular cable cover shape using equipment 14. In this type of configuration, some of wires 104 will follow the left-hand branch of cable 92 and some of the wires will follow the right-hand branch of cable 92 above bifurcation 94. Between bifurcation 94 and connector 98, all of fibers 106 may be surrounded by a single tubular intertwined cable cover structure formed from fibers 102. Tool 14 may form the portion of the cover that lies between connector 98 and bifurcation 94 from 32 of fibers 102 (as an example). Above bifurcation 94, 16 of the 32 fibers 102 may be intertwined to form the intertwined cable cover for the left-hand branch of cable 92 and 16 of the 32 fibers 102 may be intertwined to form the intertwined cable cover for the right-hand branch of cable 92.

Different portions of cable 92 may be subject to different forces. For example, the fibers in the region of bifurcation 94 (FIG. 1) may be susceptible to unraveling (e.g., when pulled apart as with a chicken bone). Cable 92 may also be susceptible to wear in the vicinity of connector 98.

To address these concerns, tools 14 may include computer-controlled servo motors that are used to adjust the tension of fibers 102 (i.e., intertwining tension) and the speed with which cable 92 is passed through the intertwining tool (which controls intertwining density and fiber-to-fiber pitch). By adjusting intertwined formation attributes such as fiber tension and intertwining density (pitch) in real time during the intertwining process, the physical attributes of the intertwined structures (i.e., the closeness of the weave braid, or other intertwining and therefore the flexibility and durability of the intertwined structures) may be varied as a function of position along the longitudinal axis (length) of cable 92. In portions of cable 92 that are subject to potential wear such as bifurcation 94, the intertwined structures may be formed in a stiffer and more durable configuration (e.g., by using a higher intertwining density, by intertwining together fibers using a higher fiber tension, and/or by increasing stiffness by locally increasing the number of layers of fiber 102 in the intertwined structures). A strain relief structure may be formed in this way at connector 98 if desired.

After intertwining fibers 102 to form cable cover 100 using tools 14, tools 16 may be used to process cable 92. Tools 16 may include tools such as molds, spraying equipment, and other suitable equipment for incorporating binder into portions of the intertwined fibers produced by intertwining equipment 14. Tools 16 may also include dipping tools for forming coatings, heating tools for applying heat to cable 92 (e.g., to melt, dry, or cure a binder, to melt fibers in cable cover 100 or elsewhere in cable 92, etc.). An ultraviolet (UV) lamp may be included in tools 16 for UV curing operations. A cutting tool may include blades or other cutting equipment for dividing cover 100 and fibers 106 into desired lengths for forming cable 92 for accessory 88. The tools of equipment 16 may be controlled by computers or other suitable control equipment. If desired, additional tools may be included in system 10. The examples of FIG. 3 are merely illustrative.

Equipment in system 10 such as intertwining tool 14 and equipment 16 may be used to form finished parts such as finished part 26 (e.g., cable 92 for headset 88 of FIG. 1) or other structures from fibers provided from fiber sources 12.

Conventional cables often have unsightly and bulky strain relief structures. Conventional cables with strain relief structures are shown in FIGS. 4 and 5.

Figure 4:
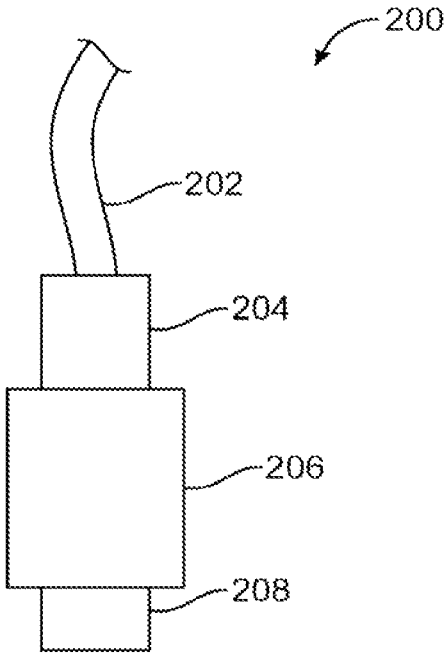
(PRIOR ART) FIG. 4
FIG. 4 is a side view of a conventional cable strain relief structure.

A conventional cable without a fiber cover is shown in FIG. 4. As shown in FIG. 4, cable 200 may have a plastic-coated cable portion 202 that is terminated to electrical connector 208 using elastomeric strain relief structure 204 and plastic connector shell 206. Structures such as structure 204 may help prevent cable 200 from being damaged when cable 202 is flexed during use, but may be undesirably bulky and unsightly.

Figure 5:
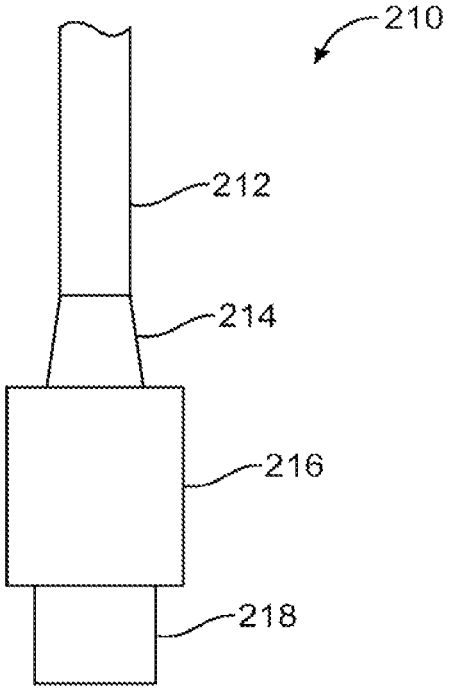
(PRIOR ART) FIG. 5
FIG. 5 is a side view of a conventional strain relief structure in an intertwined cable.

A conventional cable with an intertwined cover is shown in FIG. 5. As shown in FIG. 5, intertwined-structure-covered cable portion 212 of cable 210 may be attached to plastic connector shell 216 and electrical connector 218 using elastomeric strain relief structure 214. As with structures such as structure 204 of FIG. 4, structure 214 of FIG. 5 may help prevent cable 210 from being damaged when cable 210 is flexed during use, but may be undesirably bulky and unsightly. Bulky elastomeric covers of the type that are sometimes placed over the bifurcations in conventional fiber-covered cables to prevent the fibers of the cable cover from unraveling may also be undesirably bulky and unsightly.

Figure 6:
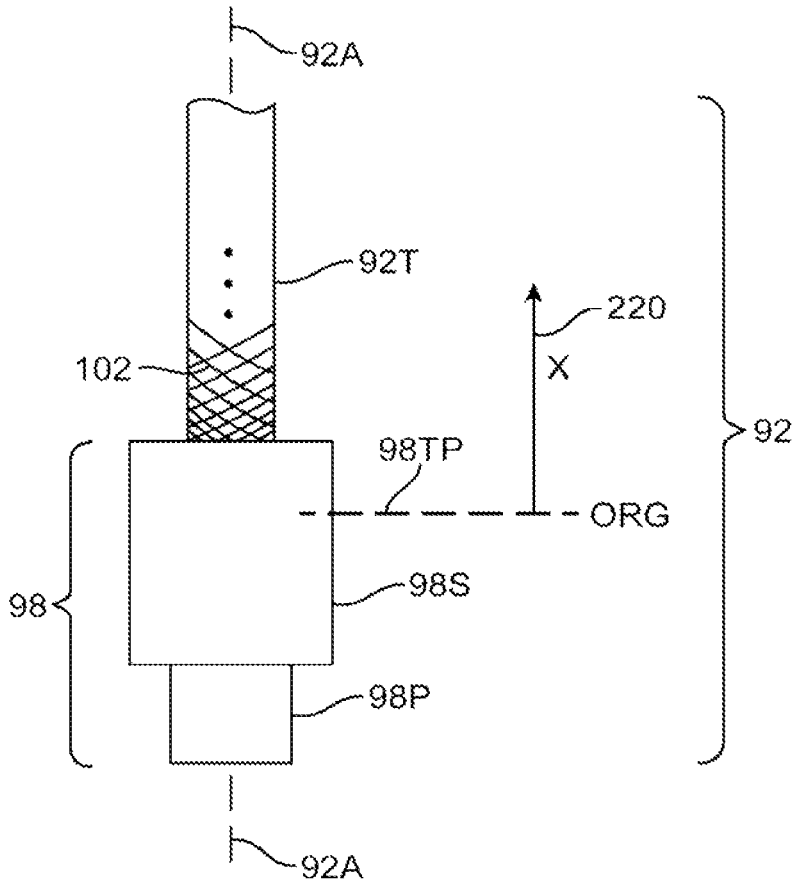
FIG. 6 is a side view of a cable with a strain relief structure in accordance with an embodiment of the present invention.

As shown in FIG. 6, cable 92 (see, e.g., FIG. 1) may have a fiber-covered portion 92T that is terminated to electrical connector member 98P (e.g., an audio jack or other multi-terminal electrical connector member in connector 98) using optional connector shell 98S (e.g., a plastic or metal shell or a shell formed from one or more pieces of other materials) and the fibers 102 of cable portion 92T.

Cable 92 has longitudinal axis 92A. Distance along the longitudinal dimension (length) of cable 92 may be represented by distance X. The distance X may be measured in direction 220 starting at origin ORG. Origin ORG may be longitudinally aligned with top surface of shell 98S, may be longitudinally aligned with an internal portion of connector 98 (e.g., a position within connector shell 98S such as position 98TP as shown in FIG. 6), or may be longitudinally aligned with the bottom edge of shell 98S (as examples).

To form an integral strain relief structure within cable 92 without adding unsightly strain relief structures such as structures 204 and 214 of FIGS. 4 and 5, tools 14 (FIG. 3) may alter intertwined formation attributes and therefore the physical attributes of the resulting intertwined structure formed from fibers 102 as a function of X.

Figure 7:
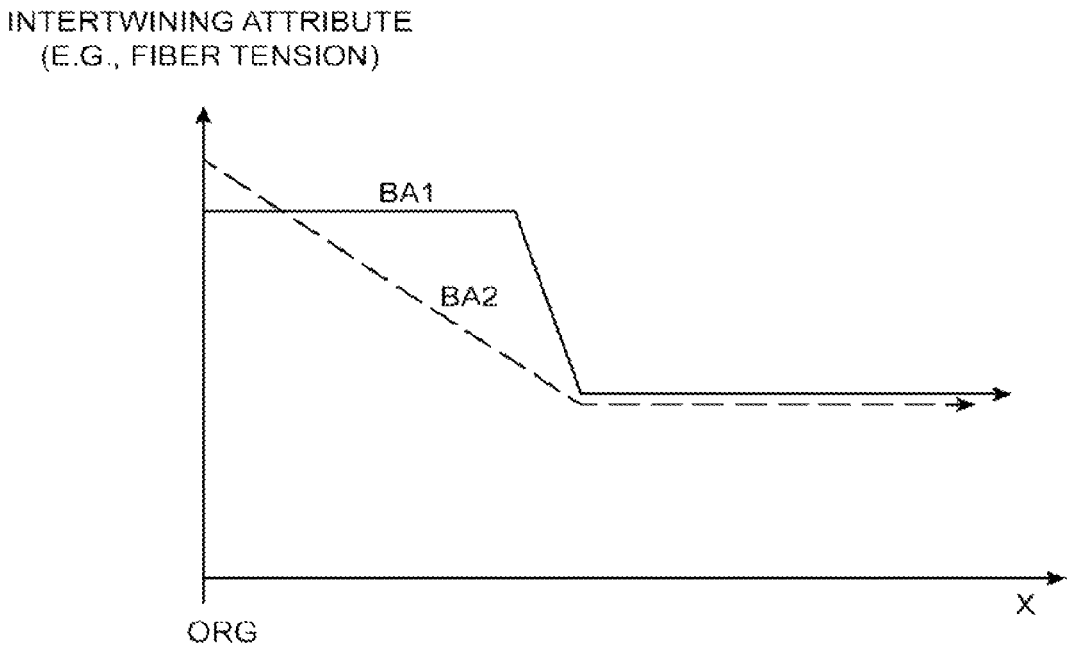
FIG. 7 is a graph showing how intertwined attributes may be varied as a function of length along a cable in the vicinity of a cable strain relief region by varying fiber tension and/or pull speed during intertwining operations in accordance with an embodiment of the present invention.

Consider, as an example, the graph of FIG. 7. As shown in FIG. 7, intertwining attributes such as fiber tension, intertwining density, and other aspects of the intertwining may be varied by tools 14 so that these attributes are different near origin ORG than they are farther away from origin ORG. Illustrative intertwined attribute profile BA1 shows how intertwined attributes such as fiber tension may be reduced in a stepwise fashion at increasing values of X. Intertwined attribute profile BA2 shows how intertwined attributes such as fiber tension may be reduced more gradually. Intertwined attributes such as intertwining density may likewise be adjusted in step-wise and/or continuous fashions. With one illustrative arrangement, intertwining density and/or fiber tension is greatest in a segment of cable 92 near jack 98 (i.e., near X=ORG) and is reduced as a function of length along cable 92 away from ORG. This will tend to make the intertwining of cover 100 strongest and most resistant to wear immediately in the vicinity of connector 98 and will form an integral strain relief structure for cable 92 without the need to add an unsightly extra strain relief member to cable 92.

Figure 8:
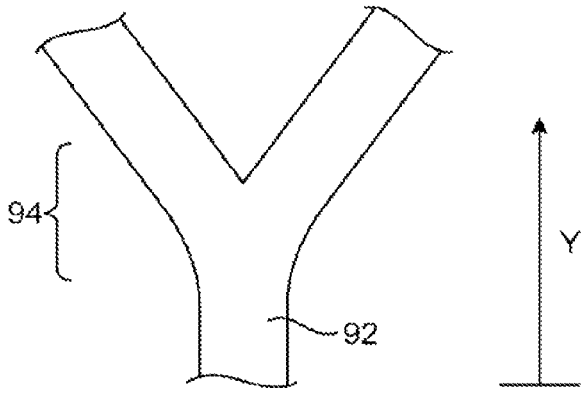
FIG. 8 is a side view of a portion of a cable with a seamless intertwined bifurcation in accordance with an embodiment of the present invention.
Figure 9:
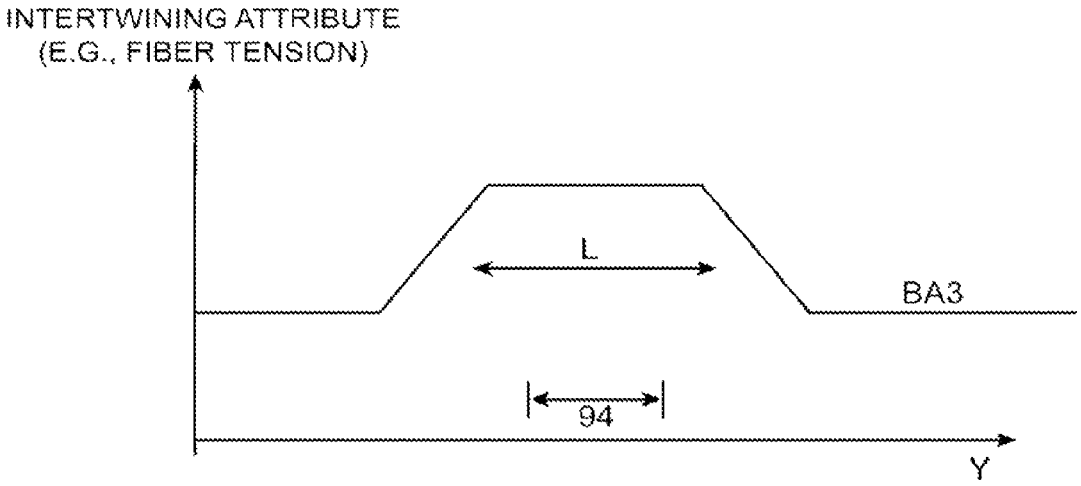
FIG. 9 is a graph showing how intertwined attributes may be varied as a function of length along a cable segment in the vicinity of a bifurcation of the type shown in FIG. 8 in accordance with an embodiment of the present invention.

The quality of cable cover 100 may also be adjusted in the vicinity of bifurcation 94 in cable 92. As shown in FIG. 8, the length along cable 92 may be measured by dimension Y in the vicinity of cable bifurcation 94. As shown by illustrative intertwined attribute profile BA3 in FIG. 9, intertwined attributes such as fiber tension, intertwining density, and other intertwining parameters may be varied as a function of dimension Y. For example, intertwining tension and/or intertwining density may be increased locally in the vicinity of bifurcation 94 to ensure that cable 92 is sufficiently strong to resist wear in the vicinity of bifurcation 94. The distance L over which there is a local strengthening of cable cover 100 of cable 92 may be, for example, 2-10 mm, 2-20 mm, 5-30 mm, more than 4 mm, less than 50 mm, or other suitable length (e.g., a segment length sufficient to extend over bifurcation region 94 while providing a smooth transition to the segments of cable 94 that have not been strengthened).

Figure 10:
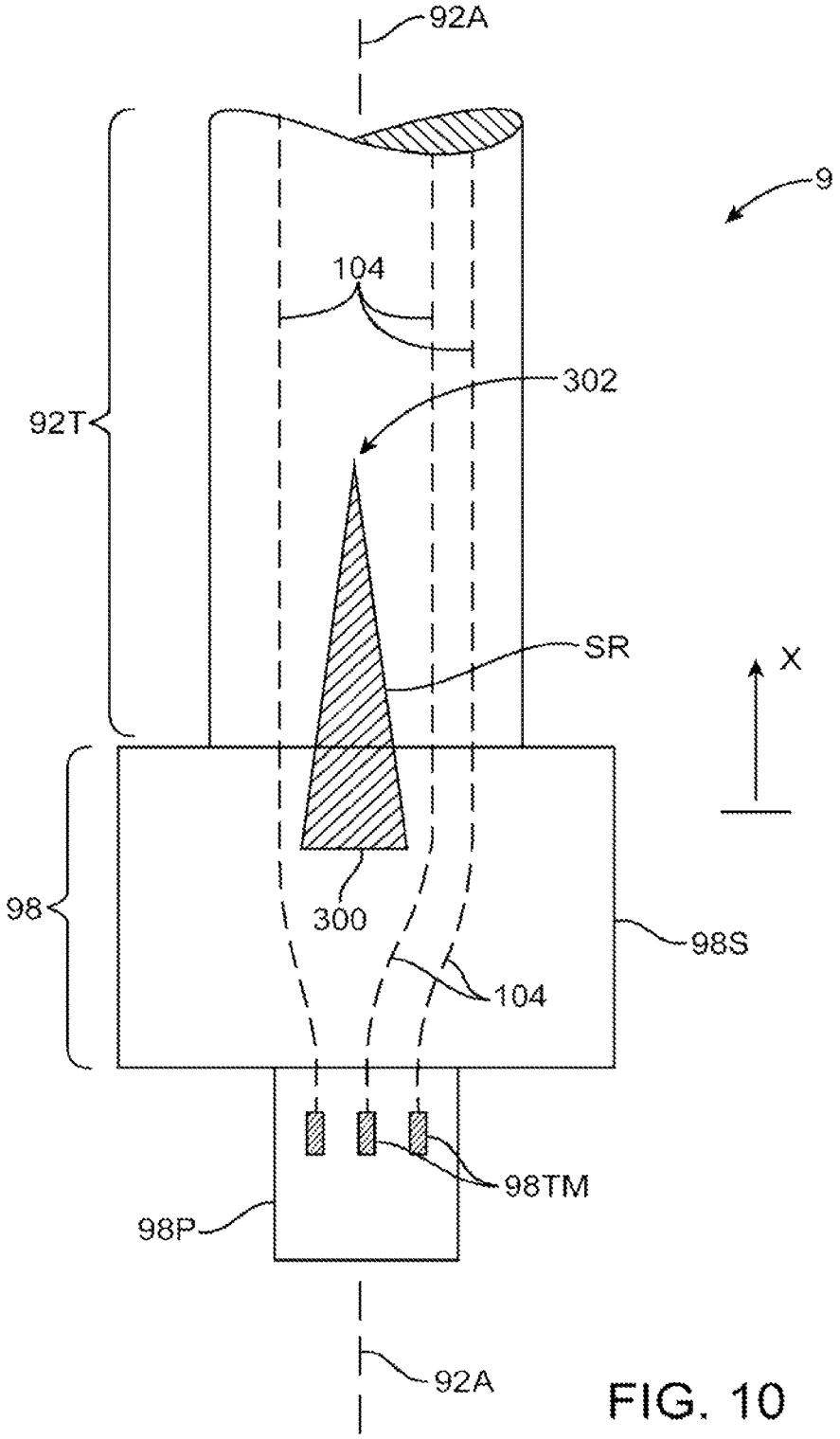
FIG. 10 is a side view of an intertwined cable with an inner strain relief member in accordance with an embodiment of the present invention.

As shown in FIG. 10, an internal strain relief member such as internal strain relief member SR may be provided within cable 92 in the vicinity of connector 98. Strain relief member SR may be formed from a material such as plastic, metal, or a fiber composite. Wires such as wires 104 may run along the interior of cable 92 and may be connected to connecter terminals 98TM (e.g., audio jack contacts) within electrical connector portion 98P of connector 98 (e.g., an audio jack). Strain relief member SR may have an elongated shape that extends along longitudinal axis 92A of cable 92 and connector 98. Strain relief member SR may have a first end such as end 300 that is mounted within connector shell 98S (e.g., using plastic, epoxy, or other suitable fillers, metal attachment structures, etc.), and may have a second end such as end 302 that is mounted within the core of cable section 92T of cable 92.

Strain relief member SR may be cylindrical, rectangular, or may have other shapes. If desired, strain relief member SR may have a stiffness that tapers off as a function of distance X, so that the amount of stiffening that is provided to cable 92 is gradually reduced as distance from connector 98 increases. This provides a smooth transition between the reinforced portion of cable 92 near connector 98 and the flexible unreinforced portion of cable 92 along its main length. The gradual reduction in stiffness of member SR may be implemented using different materials at different distances X, using different amounts of materials in member SR as a function of X, using different shapes or sizes for the cross-section of member SR as a function of X, etc.

Figure 11:
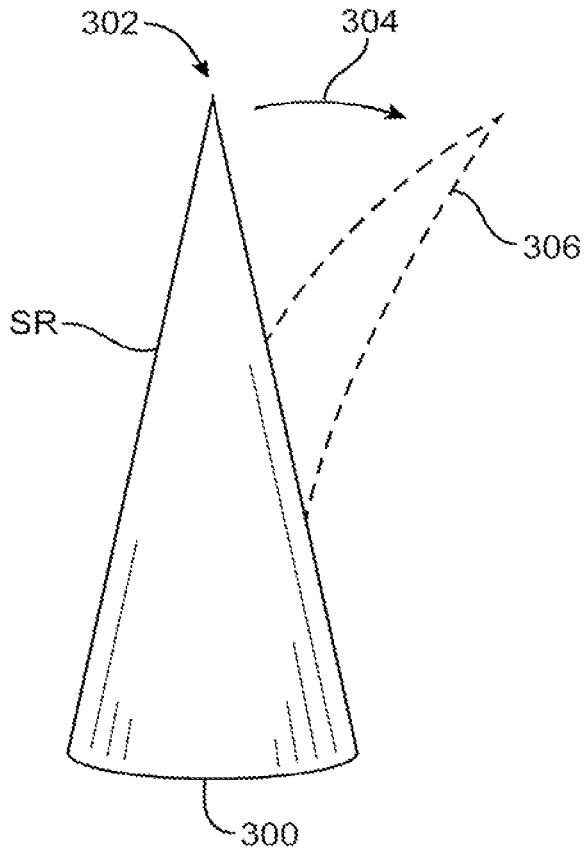
FIG. 11 is a perspective view of an illustrative strain relief member of the type that may be used in an intertwined cable such as the intertwined cable of FIG. 10 in accordance with an embodiment of the present invention.

A perspective view of an illustrative conical shape that may be used for strain relief member SR is shown in FIG. 11. When cable 92 is flexed in the vicinity of connector 98, strain relief member SR will tend to bend in direction 304 towards position 306 at narrow end 302, whereas wide end 300 will tend to remain fixed within shell structure 98S (FIG. 10).

Figure 12:
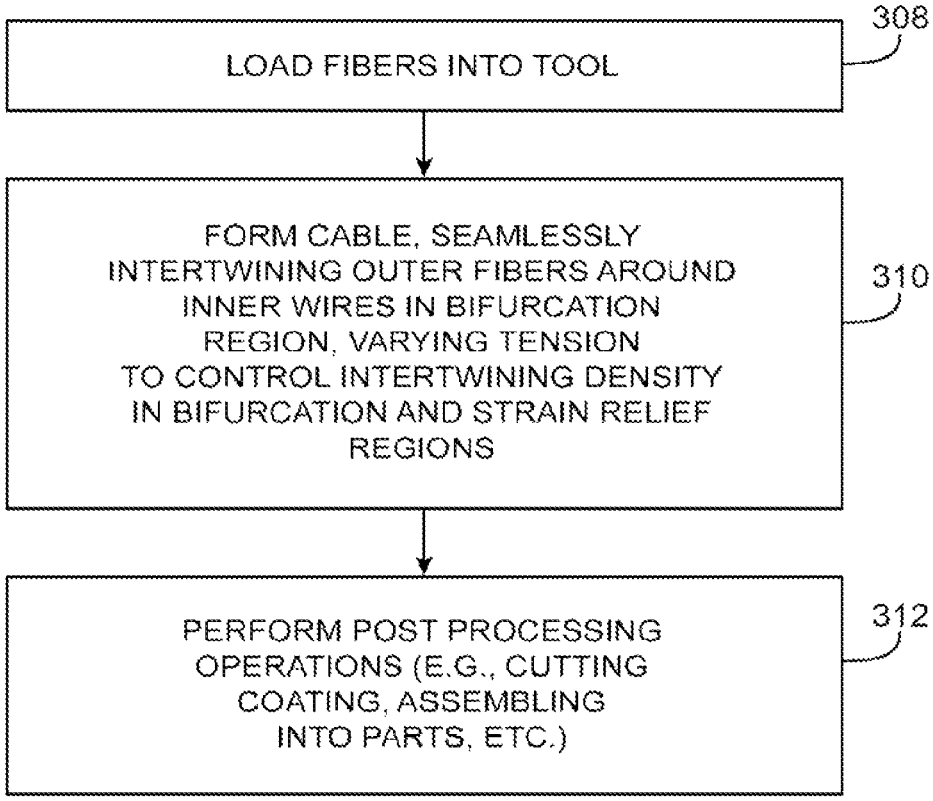
FIG. 12 is a flow chart of illustrative steps involved in forming structures based on intertwined fibers using equipment of the type shown in FIG. 3 in accordance with an embodiment of the present invention.

Illustrative steps involved in using computer-controlled intertwining equipment such as tools 14 of FIG. 3 to form integral strain relief structures and bifurcation structures in accessory 88 are shown in FIG. 12.

At step 308, fibers such as fibers 106 for the interior of cable 92 and fibers such as fibers 102 for intertwined cable cover 100 may be loaded into fiber sources 12.

At step 310, tool 14 may be used to form cover 100 around fibers 106, as shown in FIG. 2. Fibers 106 may include metal wires (e.g., insulated or bare wires 104 of stranded and/or solid copper) and one or more strengthening cords such as cord 108 of FIG. 2. Cable components such as shielding layers, plastic sheaths, and other layers (shown as layer 114 in FIG. 2) may be formed around fibers 106 (e.g., before feeding fibers 106 into the intertwining tool).

Tool 14 may braid, weave, or otherwise intertwine fibers 102 around fibers 106 and layer 114. In doing so, computer controlled servo motors may be used to control intertwining tension (e.g., by increasing or decreasing tension on each individual fiber that is being fed from a respective bobbin in the intertwining tool to the intertwined structure as the bobbin passes along a predefined track path), fiber density (e.g., by increasing or decreasing the speed with which the cable passes through the intertwining tool), or other intertwined formation attributes.

These intertwined formation attributes affect the physical attributes of the resultant intertwined cable cover 100 such as the strength of the cable cover 100, the closeness of the individual fibers to each other (e.g., the tightness of the weave, braid, or other intertwining in cover 100), the fiber density in the cover, the stiffness of the cable, the resistance of the cable cover to wear, etc. By controlling equipment 14 during intertwining, these physical attributes may be adjusted in real time to provide certain sections of cable 92 with localized strength. In particular, integral strain relief structures may be formed in the portions of cable 92 that are connected to connector 98 (e.g., by increasing the intertwining tension and/or intertwining density and thereby stiffening and strengthening the cable cover and cable to form a strain relief structure for connector 98), strengthening structures may be formed to locally adjust the attributes of cable 92 in the vicinity of bifurcation 94 relative to the other portions of cable 92 (e.g., by increasing the intertwining tension and/or intertwining density and thereby stiffening and strengthening the cable cover and cable in a 3 mm to 5 cm segment of the cable cover that surrounds bifurcation 94 to form a strengthening structure for bifurcation 94 that helps prevent fiber unraveling), etc.

During the operations of step 312, the process of forming cable 92 and headset 88 (or other suitable device) may be completed using tools 16. During these steps, tool 16 may incorporate binder into the fibers of cable cover 100, cable cover 100 may be coated with liquid, heat may be applied, a cutting tool may divide cable 92 into sections, internal strain relief members such as member SR of FIG. 10 may be incorporated into cable 92 while connecting connector 98P, shell 98S, and cable section 92T, components such as speakers for ear buds 90, buttons in controller 96, and contacts in connector 98P may be connected to wires 104, etc.

The foregoing is merely illustrative of the principles of this invention and various modifications can be made by those skilled in the art without departing from the scope and spirit of the invention.

What is claimed is:

1. A method of forming a cable with an intertwined cable cover, comprising:

intertwining fibers to form the intertwined cable cover using a computer-controlled intertwining tool, wherein the intertwined cable cover comprises at least one intertwined attribute and wherein intertwining the fibers comprises adjusting the intertwined attribute as a function of length along the intertwined cable cover in a segment of the cable that comprises a bifurcation.

2. The method defined in claim 1 wherein the intertwined attribute comprises intertwining tension and wherein intertwining the fibers comprises varying the intertwining tension as a function of length along the intertwined cable cover.

3. The method defined in claim 2 wherein intertwining the fibers comprises locally varying the intertwining tension to locally strengthen the intertwined cable cover in the segment including the bifurcation to prevent unraveling of the fibers within the bifurcation.

4. The method defined in claim 1 wherein the intertwined attribute comprises intertwining density and wherein intertwining the fibers comprises varying the intertwining density as a function of length along the intertwined cable cover.

5. The method defined in claim 4 wherein intertwining the fibers comprises locally varying the intertwining density to locally strengthen the intertwined cable cover in the segment including the bifurcation to prevent unraveling of the fibers within the bifurcation.

6. The method defined in claim 1 wherein the cable comprises wires, speakers coupled to the wires, and an audio jack coupled to the wires and wherein intertwining the fibers further comprises adjusting the computer-controlled intertwining tool to locally increase strength in the intertwined cable cover at the audio jack to form an integral strain relief structure in the intertwined cable cover at the audio jack.

7. The method defined in claim 6 further comprising:

mounting the audio jack within a shell structure; and mounting an elongated strain relief structure partly within the shell structure and partly within a segment of the intertwined cable cover.

8. A method of forming a cable, comprising:

coupling a connector to a first end of a conductor;

intertwining fibers to form an intertwined cable cover around the conductor using a computer-controlled intertwining tool, wherein the intertwined cable cover comprises at least one intertwined attribute, and wherein intertwining the fibers comprises decreasing the intertwined attribute as a function of distance from the first end of the conductor;

mounting the connector within a shell structure; and mounting an elongated strain relief structure partly within the shell structure and partly within a segment of the intertwined cable cover.

9. The method defined in claim 8 wherein the decreasing comprises adjusting the computer-controlled intertwining tool to locally increase strength in the intertwined cable cover at the connector to form an integral strain relief structure in the intertwined cable cover at the connector.

10. A method of forming a cable comprising:

intertwining fibers to form an intertwined cable cover around a conductor and along a length of the conductor; and in real-time with the intertwining, adjusting an interweaving formation parameter of the intertwining, wherein:

the adjusting causes a first segment of the cable cover to be at least one of stiffer, stronger, and more durable than a second segment of the cable cover;

the first segment and the second segment extend along different portions of the length of the conductor; and the first segment comprises a bifurcation.

11. The method of claim 10, wherein the adjusting causes the first segment of the cable cover to be at least stiffer than the second segment of the cable cover.

12. The method of claim 10, wherein the adjusting causes the first segment to be at least stronger than the second segment.

13. The method of claim 10, wherein the adjusting causes the first segment to be at least more durable than the second segment.

14. The method of claim 12, wherein:

the adjusting further causes a third segment of the cable cover to be at least one of stiffer, stronger, and more durable than the second segment of the cable cover;

the third segment and the second segment extend along different portions of the length of the conductor; and the third segment comprises an end of the conductor.

15. The method of claim 10, wherein the interweaving formation parameter comprises an intertwining density.

16. The method of claim 10, wherein the interweaving formation parameter comprises an intertwining tension.

17. The method of claim 10, wherein the interweaving formation parameter comprises a number of fiber layers.

18. The method of claim 10, wherein the adjusting is one of stepwise and gradual.

19. The method defined in claim 8, wherein the function is one of stepwise and gradual.

* * * * *